US010974510B2

(12) United States Patent
Watanabe

(10) Patent No.: US 10,974,510 B2
(45) Date of Patent: Apr. 13, 2021

(54) LIQUID EJECTING HEAD AND LIQUID EJECTING APPARATUS

(71) Applicant: SEIKO EPSON CORPORATION, Tokyo (JP)

(72) Inventor: Eiichiro Watanabe, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 8 days.

(21) Appl. No.: 16/691,024

(22) Filed: Nov. 21, 2019

(65) Prior Publication Data

US 2020/0171823 A1 Jun. 4, 2020

(30) Foreign Application Priority Data

Nov. 29, 2018 (JP) ..... JP2018-223233

(51) Int. Cl.
*B41J 2/175* (2006.01)
*B41J 2/14* (2006.01)
*B41J 2/055* (2006.01)

(52) U.S. Cl.
CPC ..... *B41J 2/1433* (2013.01); *B41J 2/055* (2013.01); *B41J 2/14233* (2013.01); *B41J 2/1752* (2013.01); *B41J 2/14201* (2013.01)

(58) Field of Classification Search
CPC .... B41J 2/1433; B41J 2/1752; B41J 2/14233; B41J 2/055; B41J 2/14201
See application file for complete search history.

(56) References Cited

U.S. PATENT DOCUMENTS

| | | | | |
|---|---|---|---|---|
| 7,837,309 | B2 * | 11/2010 | Owaki | B41J 25/34 347/85 |
| 8,500,245 | B2 | 8/2013 | Hagiwara et al. | |
| 8,567,906 | B2 | 10/2013 | Shinozaki | |
| 8,596,743 | B2 | 12/2013 | Suzuki et al. | |
| 9,061,497 | B2 | 6/2015 | Okubo | |
| 2006/0290725 | A1 | 12/2006 | Akahane | |
| 2011/0242190 | A1 | 10/2011 | Suzuki et al. | |
| 2012/0069090 | A1 | 3/2012 | Shinozaki | |
| 2012/0147094 | A1 | 6/2012 | Hagiwara et al. | |
| 2013/0050378 | A1 * | 2/2013 | Okamoto | B41J 11/006 347/104 |
| 2014/0240401 | A1 | 8/2014 | Okubo | |

(Continued)

FOREIGN PATENT DOCUMENTS

| | | |
|---|---|---|
| JP | H05-221063 | 8/1993 |
| JP | 2005-067130 | 3/2005 |
| JP | 2006-272885 | 10/2006 |

(Continued)

*Primary Examiner* — Yaovi M Ameh
(74) *Attorney, Agent, or Firm* — Workman Nydegger

(57) ABSTRACT

A liquid ejecting head includes a nozzle formation surface disposed between a first roller and a second roller in a medium transport direction, a first positioning portion used for positioning with respect to a first head holding member provided in a first liquid ejecting apparatus in which a distance between the first roller and the second roller in the medium transport direction is set to a first distance, and a second positioning portion used for positioning with respect to a second head holding member provided in a second liquid ejecting apparatus in which the distance between the first roller and the second roller in the medium transport direction is set to a second distance being different than the first distance.

19 Claims, 9 Drawing Sheets

(56) References Cited

U.S. PATENT DOCUMENTS

2019/0001687 A1* 1/2019 Sato ..... B41J 2/17596

FOREIGN PATENT DOCUMENTS

| | | |
|---|---|---|
| JP | 2007-001107 | 1/2007 |
| JP | 2008-062534 | 3/2008 |
| JP | 2011-207181 | 10/2011 |
| JP | 2011-218750 | 11/2011 |
| JP | 2012-011562 | 1/2012 |
| JP | 2012-061719 | 3/2012 |
| JP | 2012-121278 | 6/2012 |
| JP | 2014-162063 | 9/2014 |
| JP | 2015-160361 | 9/2015 |

* cited by examiner

LIQUID EJECTING HEAD AND LIQUID EJECTING APPARATUS

The present application is based on, and claims priority from JP Application Serial Number 2018-223233, filed Nov. 29, 2018, the disclosure of which is hereby incorporated by reference herein in its entirety.

BACKGROUND

1. Technical Field

The present disclosure relates to a liquid ejecting head such as an ink jet recording head that ejects a liquid from a nozzle, a liquid ejecting apparatus including the liquid ejecting head, and a method of manufacturing the liquid ejecting apparatus, and in particular, a liquid ejecting head applicable to a plurality of types of liquid ejecting apparatuses having different specifications, a liquid ejecting apparatus including the same, and a method of manufacturing the liquid ejecting apparatus.

2. Related Art

A liquid ejecting head is configured to receive a liquid supplied from a liquid storage member and eject (discharge) the liquid from a nozzle by driving a pressure generating element such as a piezoelectric element or a heating element. As a liquid ejecting apparatus including the liquid ejecting head, there is an apparatus configured to attach the liquid ejecting head to a head holding member called a carriage or the like (for example, JP-A-2005-67130). In such a configuration, in order to ensure landing accuracy of the liquid ejected from the liquid ejecting apparatus, it is important to position the liquid ejecting head and the head holding member. Therefore, in the configuration of JP-A-2005-67130, a fixing hole provided on the liquid ejecting head side is fitted with a protrusion portion provided on the head holding member side. Therefore, an arrangement position of the liquid ejecting head with respect to the head holding member, in particular, an in-plane inclination parallel to a nozzle formation surface on which the nozzle of the liquid ejecting head is formed is defined.

Incidentally, depending on the specifications of the liquid ejecting apparatus, a position of a member such as a protrusion or a recessed portion used for positioning with respect to the liquid ejecting head in the head holding member may be changed due to structural restrictions or the like. Therefore, when the specification of the liquid ejecting apparatus is changed, it is necessary to change the specification of the liquid ejecting head accordingly.

SUMMARY

According to an aspects of the present disclosure is to provide a liquid ejecting head which is mounted on a liquid ejecting apparatus including a first roller disposed on an upstream in a transport direction of a medium and a second roller disposed on a downstream in the transport direction, and which ejects a liquid onto the medium transported by the first roller and the second roller, the liquid ejecting head including a nozzle formation surface provided with a nozzle ejecting a liquid, and disposed between the first roller and the second roller in the transport direction, a first positioning portion (42) used for positioning with respect to a first head holding member (60) provided in the liquid ejecting apparatus (59) in which a distance between the first roller (67) and the second roller (68) in the transport direction is set to a first distance (Lb), and a second positioning portion (43) used for positioning with respect to a second head holding member (4) provided in the liquid ejecting apparatus (1) in which the distance between the first roller (8) and the second roller (9) in the transport direction is set to a second distance (La) shorter than the first distance.

DESCRIPTION OF EXEMPLARY EMBODIMENTS

Figure 1:
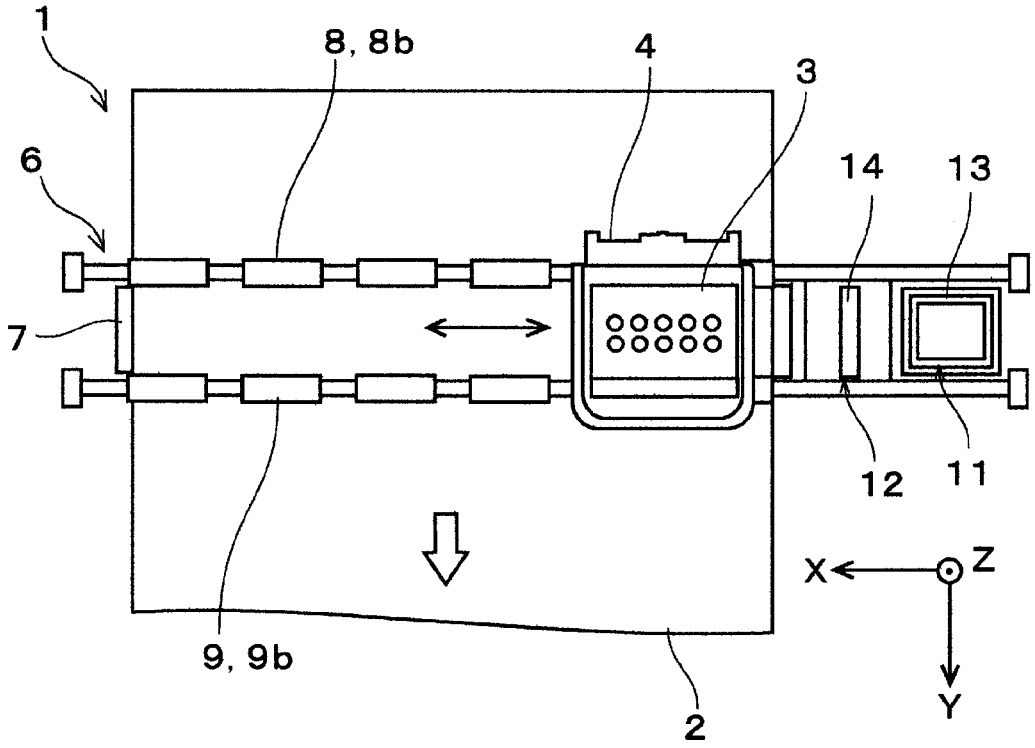
FIG. 1 is a plan view illustrating a configuration of an aspect of a liquid ejecting apparatus.

Hereinafter, embodiments for performing the present disclosure will be described with reference to the accompanying drawings. In the embodiments described below, although various limitations are made as preferred specific examples of the present disclosure, the scope of the present disclosure is not limited to these embodiments unless otherwise specified in the following description. In addition, hereinafter, a liquid ejecting apparatus 1 of first embodiment in which a liquid ejecting head 3 is mounted on a second head holding member 4 and a liquid ejecting apparatus 59 of second embodiment in which the liquid ejecting head 3 is mounted on a first head holding member 60 will be mainly exemplified and described. The liquid ejecting apparatus 1 of the first embodiment is an example of a second apparatus, the liquid ejecting apparatus 59 of the second embodiment is an example of a first apparatus.

Figure 2:
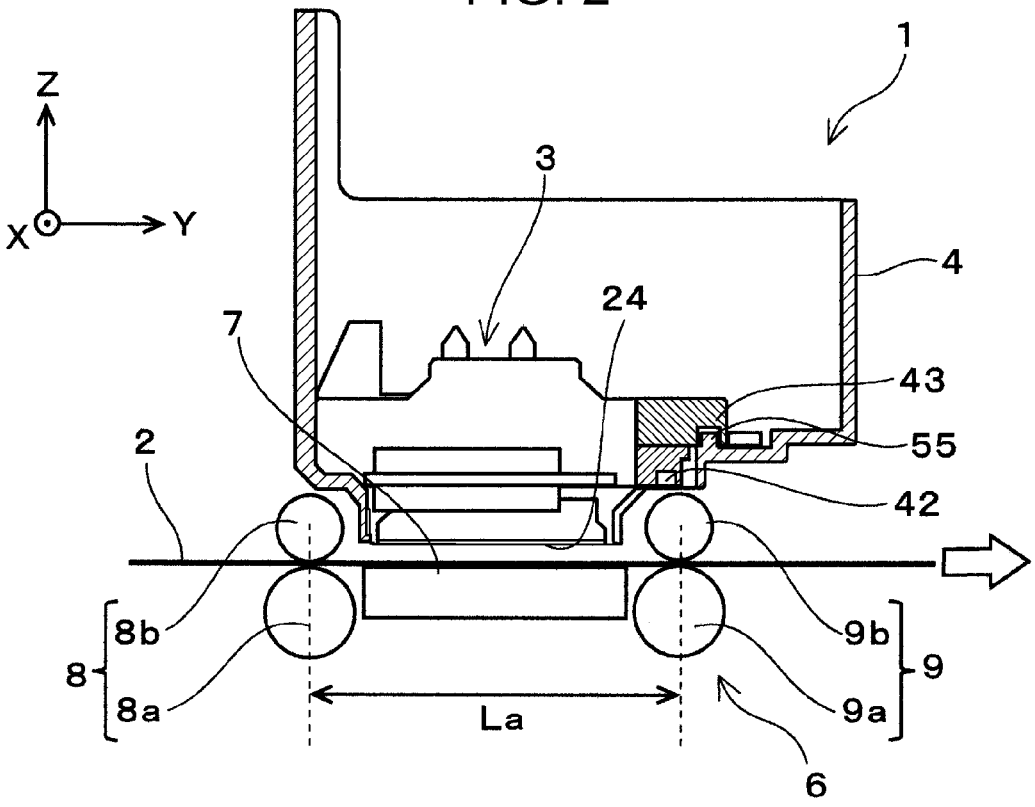
FIG. 2 is a side view illustrating a configuration of a periphery of a liquid ejecting head.

FIG. 1 is a plan view illustrating a configuration of an aspect of the liquid ejecting apparatus 1 according to the first embodiment, and FIG. 2 is a side view illustrating a peripheral configuration of the liquid ejecting head 3 in the liquid ejecting apparatus 1. In FIG. 2, a portion of the second head holding member 4 and the liquid ejecting head 3 is illustrated in cross section. The liquid ejecting apparatus 1 according to the present embodiment is an apparatus that prints and records an image or the like by ejecting a liquid ink (a type of liquid in the present disclosure) onto a surface of a medium 2. The liquid ejecting apparatus 1 is provided with the liquid ejecting head 3, the second head holding member 4 to which the liquid ejecting head 3 is attached, a transport mechanism 6 that transports the medium 2 in a sub-scanning direction, and a head moving mechanism (not illustrated) that moves the second head holding member 4 in a main scanning direction as a width direction of the medium 2. The medium 2 of the present embodiment is a recording paper such as a sheet or continuous paper, a cloth, a resin film, or the like. The medium 2 is configured to be transported onto a platen 7, which is a type of medium support member, disposed at a distance from a nozzle formation surface (refer to FIG. 7) on which the nozzles 29 of the liquid ejecting head 3 are formed by driving the transport mechanism 6, and discharged from the liquid ejecting apparatus 1 after an ink ejected from each of the nozzles 29 of the liquid ejecting head 3 is landed and an image is printed. In the following, among the X, Y, and Z directions orthogonal to one another, a main scanning direction of the liquid ejecting head 3 is defined as an X direction, and a sub-scanning direction as a transport direction of the medium 2 is defined as a Y direction. A plane parallel to the nozzle formation surface of the liquid ejecting head 3 is defined as an XY plane, and a direction orthogonal to the nozzle formation surface, that is, the XY plane is defined as a Z direction.

The transport mechanism 6 is provided with a first roller 8 positioned on the upstream of the nozzle formation surface than the liquid ejecting head 3 mounted on the second head holding member 4 in the Y direction, and a second roller 9 positioned on the downstream than the nozzle formation surface. The first roller 8 has a driving roller 8*a* forming a pair in the Z direction and a driven roller 8*b* driven by the driving roller 8*a* , and is configured to be rotatable in directions opposite to each other in a state where the medium 2 is pinched between the driving roller 8*a* and the driven roller 8*b* . The driving roller 8*a* is driven by power from a paper feed motor (not illustrated). The driving roller 8*a* and the driven roller 8*b* rotate in directions opposite to each other while the medium 2 is pinched between the driving roller 8*a* and the driven roller 8*b* driven by the driving roller 8*a* . Therefore, the medium 2 is transported between the nozzle formation surface of the liquid ejecting head 3 and the platen 7. Similarly to the first roller 8, the second roller 9 is configured to include a driving roller 9*a* and a driven roller 9*b* driven by the driving roller 9*a* , which form a pair in the Z direction. The driving roller 9*a* and the driven roller 9*b* rotate in directions opposite to each other while the printed medium 2 is pinched to guide the medium 2 to the paper discharge side. Hereinafter, the two driving rollers 8*a* and the driven roller 8*b* which are paired as described above are simply referred to as the first roller 8 (second roller 9 is also the same) unless it is particularly necessary to distinguish these.

Here, although the transport mechanism 6 is provided with a plurality of rollers (not illustrated) other than the first roller 8 and the second roller 9, the first roller 8 is a roller disposed on the upstream than the nozzle formation surface in the Y direction and is a roller disposed at a position closest to the nozzle formation surface among the rollers provided in the transport mechanism 6. Similarly, the second roller 9 is a roller disposed on the downstream than the nozzle formation surface in the Y direction and is a roller disposed at a position closest to the nozzle formation surface. The rollers 8*b* and 9*b* exemplified as the driven rollers in the present embodiment may be driving rollers that are driven by power similarly to the rollers 8*a* and 9*a* . That is, it is possible to adopt a configuration in which the rollers 8*a* and 8*b* constituting the first roller 8 are rotationally driven in directions opposite to each other. Similarly, it is possible to adopt a configuration in which the rollers 9*a* and 9*b* constituting the second roller 9 are rotationally driven in directions opposite to each other. In addition, in the present embodiment, a configuration is exemplified in which the rollers 8*a* and 9*a* disposed on the opposite side of the recording surface of the medium 2, that is, the lower side (negative side) in the Z direction are the driving rollers, and the rollers 8*b* and 9*b* disposed on the recording surface side of the medium 2, that is, the upper side (positive side) in the Z direction are the driven rollers, and the rollers are not limited thereto. It is also possible to adopt a configuration in which the rollers 8*b* and 9*b* disposed on the upper side in the Z direction are the driving rollers and the rollers 8*a* and 9*b* disposed on the lower side in the Z direction are the driven rollers.

As the above ink, various inks such as water-based ink and solvent-based ink can be used. Such an ink is stored in an ink cartridge (not illustrated) as a liquid storage member. The ink cartridge is detachably attached to the second head holding member 4. In addition, a configuration may be adopted in which the liquid storage member is disposed on the main body side of the liquid ejecting apparatus 1 and the ink is supplied from the liquid storage member to the liquid ejecting head 3 through a supply tube (not illustrated). As the liquid storage member, a tank-like member that can be refilled with the ink can also be adopted. In such a configuration, the second head holding member 4 is equipped with a member called a sub tank capable of adjusting the ink supply pressure.

A home position, which is a standby position of the liquid ejecting head 3, is set at a position deviated from one end side (right side in FIG. 1) that is a negative side in the X direction with respect to the platen 7. In this home position, a capping mechanism 11 and a wiping mechanism 12 are provided in order from one end side to the other end side, which is the positive side in the X direction. The capping mechanism 11 includes, for example, a cap 13 made of an elastic member such as an elastomer, and is configured to be convertible into a sealed state (in other words, capping state) where the cap 13 is brought into contact with the nozzle formation surface of the liquid ejecting head 3 and sealed or a retracted state separated from the nozzle formation surface. The space inside the cap is suctioned by a negative pressure mechanism such as a suction pump (not illustrated) with the nozzle formation surface capped. Therefore, a cleaning operation as a type of maintenance is performed to discharge a thickened ink, bubbles, and the like together with the ink from the nozzles 29 of the liquid ejecting head 3 into the cap.

The wiping mechanism 12 performs a wiping operation as a type of maintenance to wipe the nozzle formation surface of the liquid ejecting head 3 by a wiper 14. The wiping mechanism 12 according to the present embodiment is configured to be convertible into a state where the wiper 14 is in contact with the nozzle formation surface or a retracted state separated from the nozzle formation surface. The wiper 14 can adopt various configurations. For example, the wiper 14 is made of an elastic blade body whose surface is covered with a cloth. In the present embodiment, in a state where the wiper 14 is in contact with the nozzle formation surface, the liquid ejecting head 3 moves in the main scanning direction, so that the wiper 14 slides on the nozzle formation surface and wipes. It is also possible to adopt a configuration in which the nozzle formation surface is wiped by the wiper 14 self-running with the liquid ejecting head 3 stopped moving.

Figure 3:
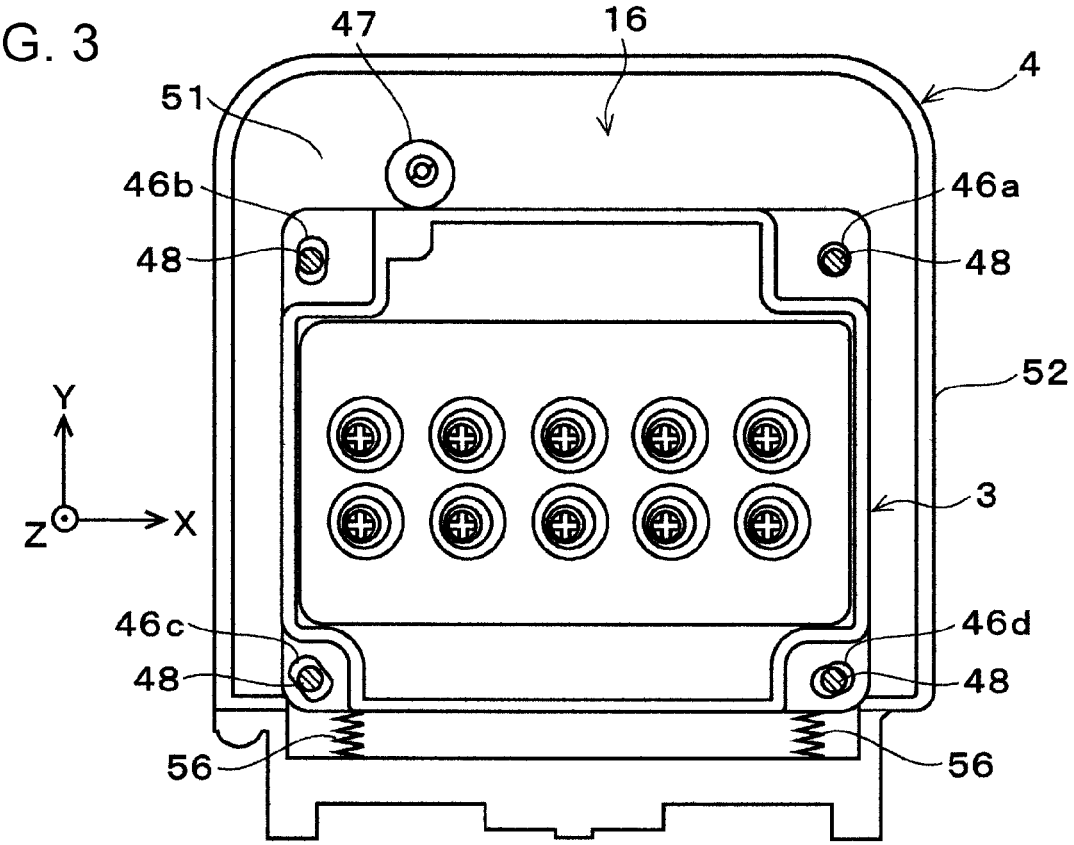
FIG. 3 is a top view illustrating a configuration of an aspect of a second head holding member.
Figure 4:
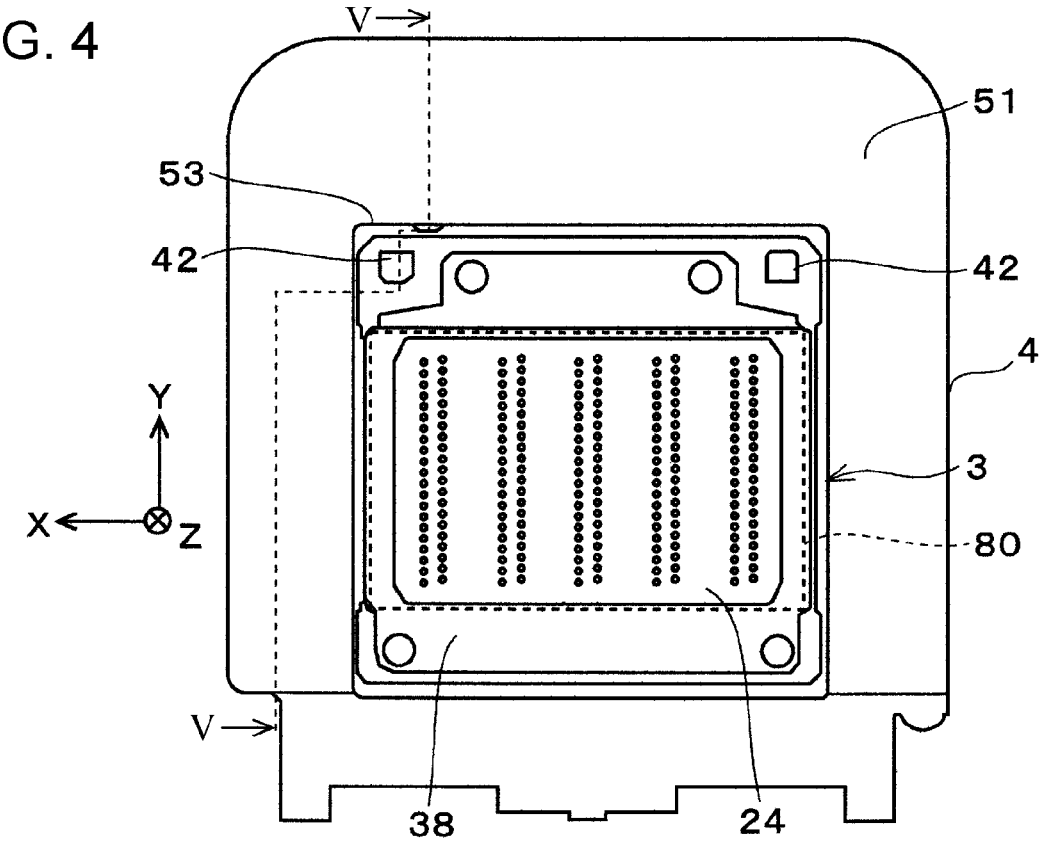
FIG. 4 is a bottom view illustrating a configuration of an aspect of the second head holding member.
Figure 5:
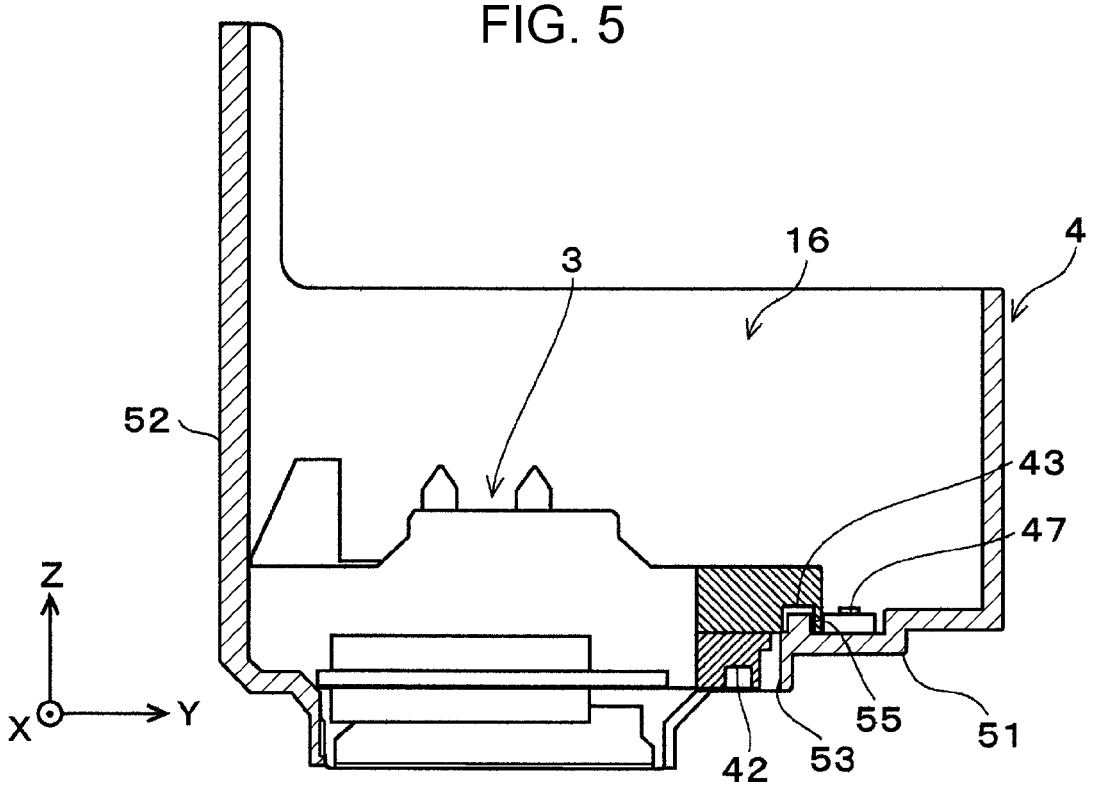
FIG. 5 is a cross-sectional view taken along the line V-V in FIG. 4.
Figure 6:
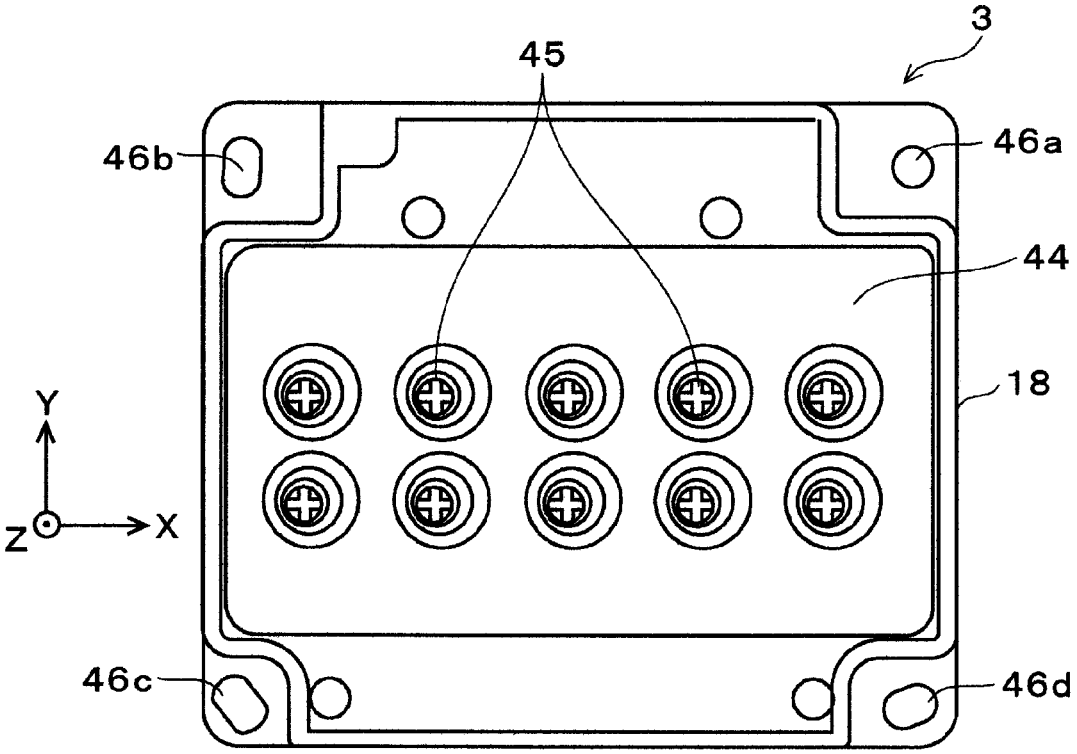
FIG. 6 is a top view illustrating a configuration of an aspect of the liquid ejecting head.
Figure 7:
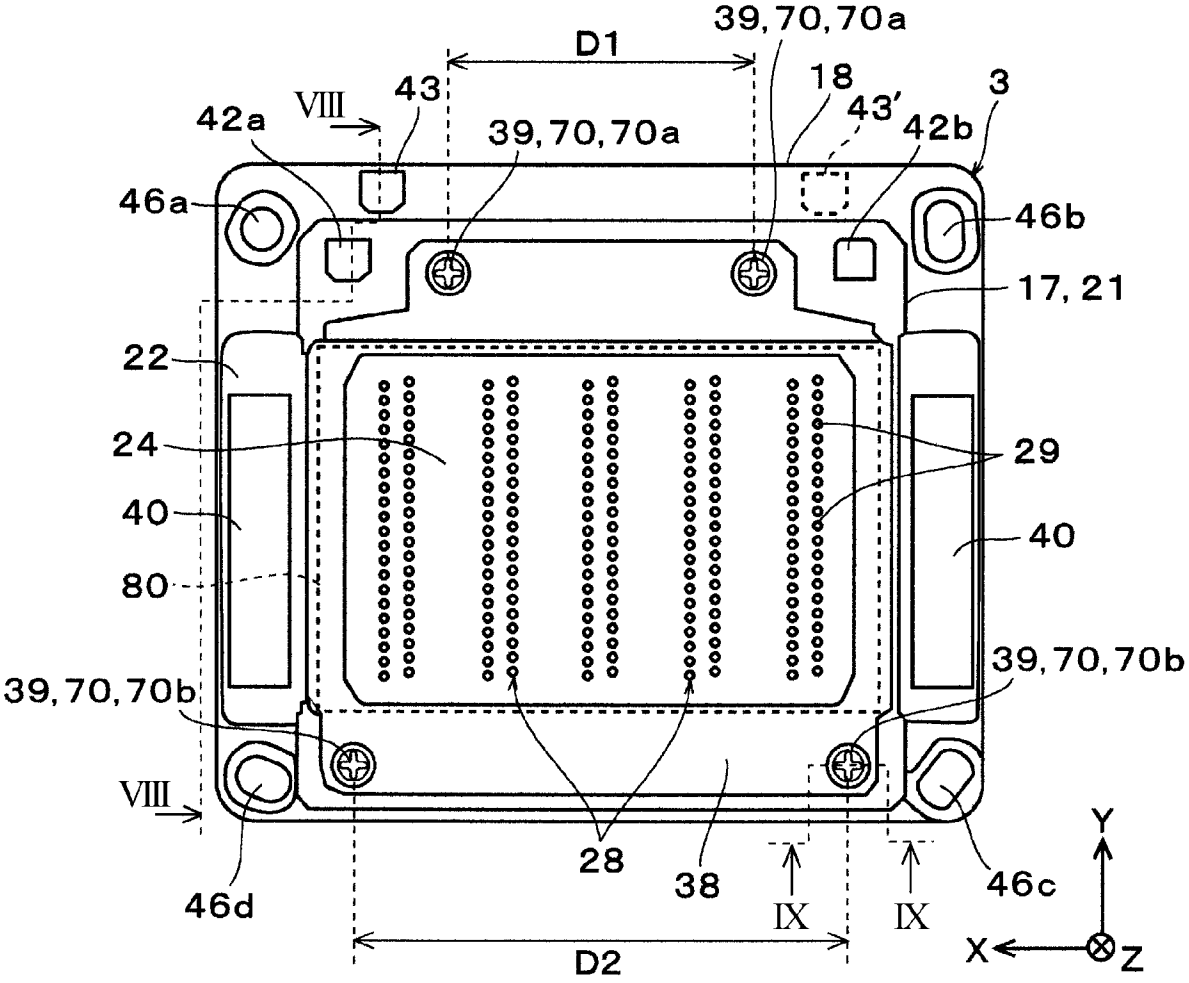
FIG. 7 is a bottom view illustrating a configuration of an aspect of the liquid ejecting head.
Figure 8:
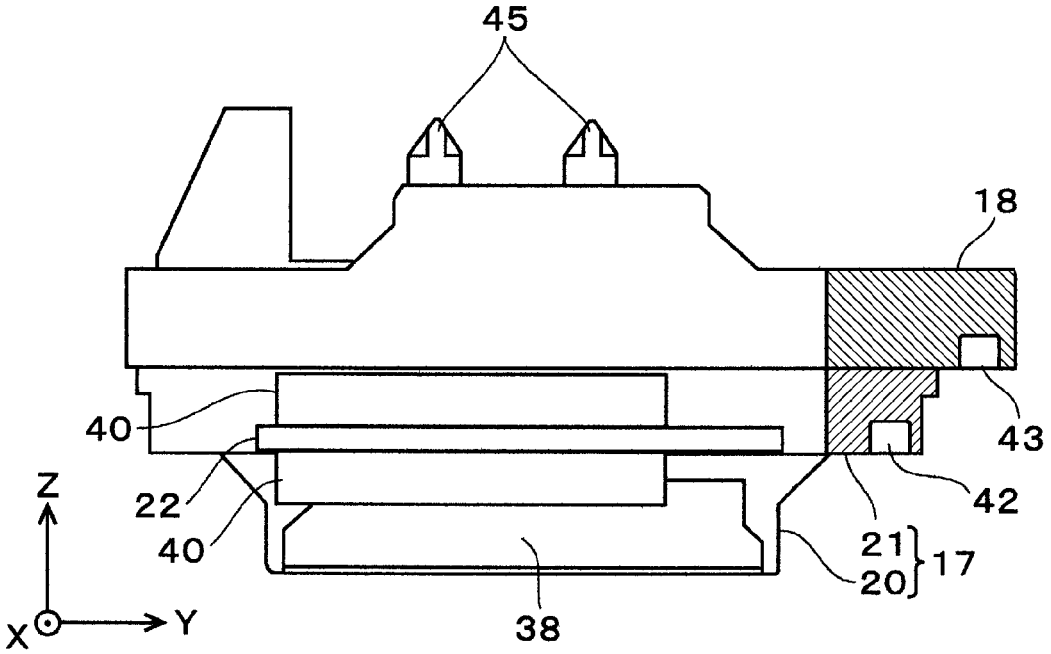
FIG. 8 is a cross-sectional view taken along the line VIII-VIII in FIG. 7.
Figure 9:
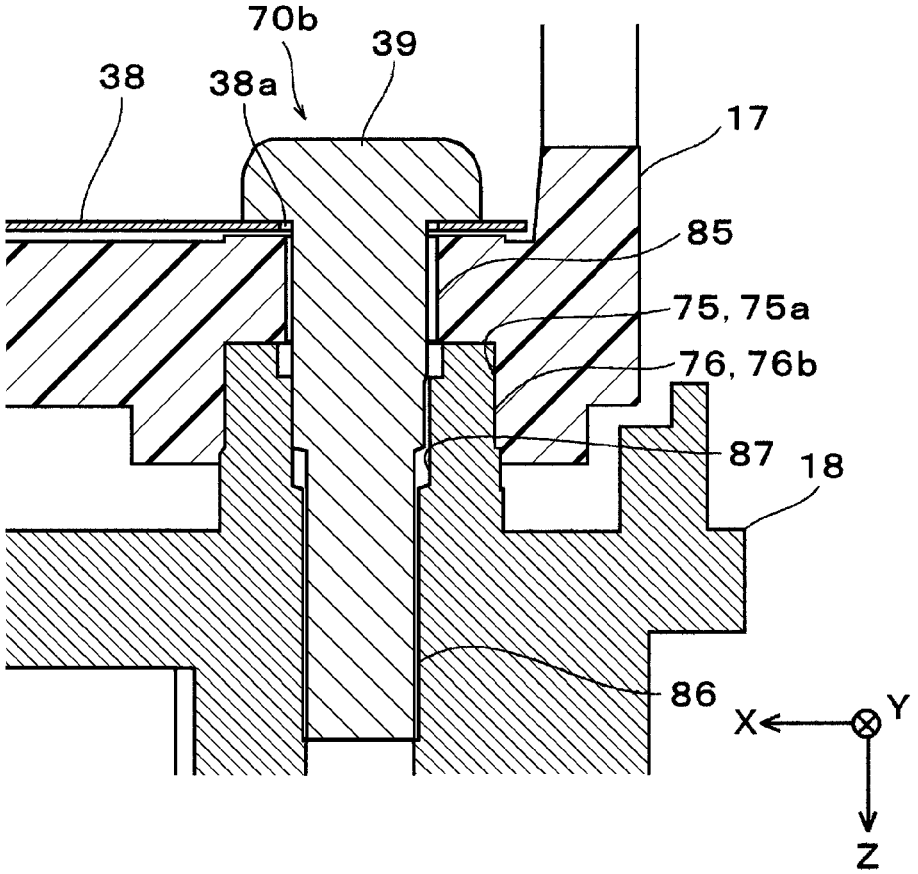
FIG. 9 is a cross-sectional view taken along the line IX-IX in FIG. 7.

FIGS. 3 to 5 are views illustrating a configuration of the second head holding member 4 with the liquid ejecting head 3 attached thereto. FIG. 3 is a top view, FIG. 4 is a bottom view, and FIG. 5 is a cross-sectional view taken along the line V-V in FIG. 4. In addition, FIGS. 6 to 8 are views illustrating a configuration of an aspect of the liquid ejecting head 3. FIG. 6 is a top view, FIG. 7 is a bottom view, FIG. 8 is a cross-sectional view taken along the line VIII-VIII in FIG. 7, and FIG. 9 is a cross-sectional view taken along the line IX-IX in FIG. 7. Furthermore, FIG. 10 is a cross-sectional view illustrating a configuration of a liquid ejecting unit 19 in the liquid ejecting head 3.

The liquid ejecting head 3 according to the present embodiment is provided with a case head 17, an introduction path unit 18 stacked on the upper surface side in the Z direction of the case head 17, and a liquid ejecting unit 19 (refer to FIG. 10) fixed to the lower surface side of the case head 17 in the Z direction.

The case head 17 is molded of, for example, a synthetic resin, and is configured to include a box-shaped case main body 20 to which the liquid ejecting unit 19 is fixed, and a flange portion 21 in which the introduction path unit 18 is disposed so as to extend from the upper surface side of the case main body portion 20 in the Z direction (in other words, introduction path unit 18 side) to the side in the X direction. Inside the case head 17, a flow path (not illustrated) for supplying the ink from the introduction path unit 18 to the liquid ejecting unit 19 side, a circuit substrate 22, and the like are accommodated.

Figure 10:
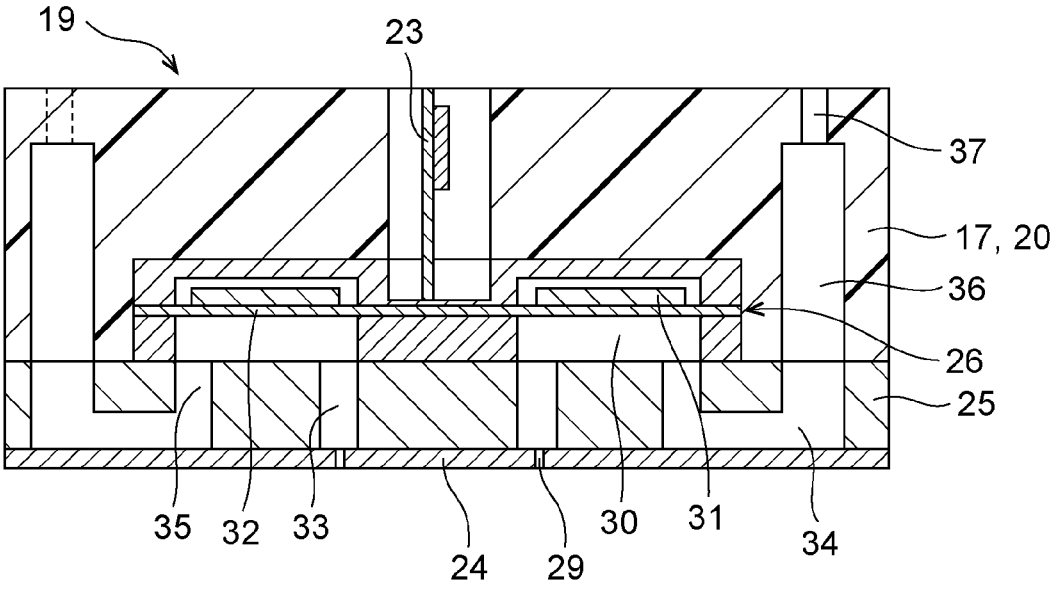
FIG. 10 is a cross-sectional view illustrating a configuration of an aspect of a liquid ejecting unit.

As illustrated in FIG. 10, the liquid ejecting unit 19 attached to the front end surface of the case main body 20 is formed as a unit by laminating a plurality of constituent members such as a nozzle plate 24, a communication plate 25, and an actuator substrate 26 and bonding these members with an adhesive or the like. The actuator substrate 26 according to the present embodiment has a plurality of pressure chambers 30 respectively communicating with a plurality of nozzles 29 formed in the nozzle plate 24, and a plurality of piezoelectric elements 31 which are pressure generating elements causing pressure fluctuations in the ink in each of the pressure chambers 30. A diaphragm 32 is provided between the pressure chamber 30 and the piezoelectric element 31, and the upper opening of the pressure chamber 30 is sealed by the diaphragm 32 and a portion of the pressure chamber 30 is partitioned. The piezoelectric elements 31 are laminated in areas corresponding to each of the pressure chambers 30 on the diaphragm 32. The piezoelectric element 31 according to the present embodiment is formed by sequentially laminating a lower electrode layer, a piezoelectric layer, and an upper electrode layer (none of which are illustrated) on the diaphragm 32, for example. A drive signal is applied to the piezoelectric element 31 configured in this manner from the circuit substrate 22 through a wiring member 23 such as a chip on film (COF). When a drive signal is applied, the piezoelectric element 31 bends and deforms when an electric field corresponding to the potential difference between the two electrodes is applied between the lower electrode layer and the upper electrode layer.

On the lower surface of the actuator substrate 26, the communication plate 25 having a larger area than the actuator substrate 26 in a plan view viewed from the substrate laminating direction is bonded. In the communication plate 25 according to the present embodiment, a nozzle communication port 33 for communicating the pressure chamber 30 with the nozzle 29, a common liquid chamber 34 provided in common to each of the pressure chambers 30, and an individual communication port 35 for communicating the common liquid chamber 34 with the pressure chamber 30. The common liquid chamber 34 is an empty portion that extends along the direction where the nozzles 29 are disposed in parallel. A plurality of individual communication ports 35 are formed along a nozzle row direction corresponding to each of the pressure chambers 30. The individual communication port 35 communicates with an end portion of the pressure chamber 30 opposite to a portion communicating with the nozzle communication port 33.

The nozzle plate 24 having a plurality of nozzles 29 formed thereon is bonded to the lower surface of the above communication plate 25. The nozzle plate 24 is bonded by an adhesive or the like in a state where the nozzle communication port 33 and the nozzle 29 communicate with each other on the lower surface of the communication plate 25. As illustrated in FIG. 7, on the nozzle plate 24 according to the present embodiment, a total of ten nozzle rows 28 in which a plurality of the nozzles 29 are is disposed in parallel are disposed in parallel in the X direction. In the present embodiment, each of the nozzle rows 28 is configured to be aligned in the Y direction, which is the transport direction of the medium 2. The adjustment of the inclination of each of the nozzle rows 28 in the Y direction will be described later.

The actuator substrate 26 and the communication plate 25 are fixed to the lower surface of the case main body 20 of the case head 17 in the Y direction. Inside the case head 17, introduction liquid chambers 36 that communicate with the common liquid chamber 34 of the communication plate 25 are formed on both sides of the actuator substrate 26. In addition, introduction ports 37 communicating with each of the introduction liquid chambers 36 are respectively opened on the upper surface of the case head 17. The ink sent from the introduction path unit 18 side is introduced into the introduction port 37, the introduction liquid chamber 36, and the common liquid chamber 34, and is supplied from the common liquid chamber 34 to each of the pressure chambers 30 through the individual communication port 35. In the liquid ejecting unit 19 having the above configuration, in a state where the flow path from the introduction liquid chamber 36 to the nozzle 29 through the common liquid chamber 34 and the pressure chamber 30 is filled with the ink, when the piezoelectric element 31 is driven, a pressure fluctuation occurs in the ink in the pressure chamber 30, and the ink is ejected from a predetermined nozzle 29 due to the pressure fluctuation (in other words, pressure vibration). The liquid ejecting head 3 and the liquid ejecting unit 19 are not limited to the exemplified configuration, and various well-known configurations can be adopted.

In addition, as illustrated in FIG. 7, a cover member 38 is attached to the lower surface of the case main body 20 so as to surround a peripheral edge of the liquid ejecting unit 19 in a state where a region where the nozzle 29 of the nozzle plate 24 is formed is exposed. The cover member 38 is made of, for example, a thin metal plate member, and has a function of protecting the liquid ejecting unit 19 and grounding the nozzle plate 24 by being coupled to a ground wire (not illustrated). In the present embodiment, the lower surface in the Z direction of the cover member 38, that is, the surface facing the medium 2 in the printing operation, and an exposed portion of the nozzle plate 24 on the lower surface correspond to the nozzle formation surface of the liquid ejecting head 3. Therefore, the case head 17 disposed at a position closer to the nozzle formation surface in the Z direction than the introduction path unit 18 corresponds to a first member in the present disclosure. The introduction path unit 18 disposed at a position farther on the positive side than the nozzle formation surface in the Z direction than the case head 17 corresponds to a second member in the present disclosure. The cover member 38 is fixed to the flange portion 21 of the case head 17 by a fixed member 39 such as a screw.

As illustrated in FIG. 9, the fixed member 39 according to the present embodiment is respectively inserted through an insertion hole 38*a* formed in cover member 38 and a through-hole 85 formed in flange portion 21, and is screwed into a female screw portion 86 provided in the introduction path unit 18, and thus fixes the cover member 38 to the flange portion 21. As a result, the cover member 38, the case head 17, and the introduction path unit 18 are fixed to one another. Hereinafter, a portion of the cover member 38, which is fixed to the case head 17 by the fixed member 39 (that is, a portion in which the insertion hole 38*a* is formed) is referred to as a fixed portion 70.

As illustrated in FIG. 7, a distance in the X direction between the fixed portions 70 disposed in parallel in the X direction (that is, distance between centers) is different between a distance on the upstream and a distance on the downstream in the Y direction that is the transport direction. More specifically, a distance D1 in the X direction between the fixed portions 70*a* on a side where a first positioning portion 42 described later is provided in the Y direction is shorter than a distance D2 in the X direction between the fixed portions 70*b* on a side where the first positioning portion 42 is not formed in the Y direction (that is, opposite side with the nozzle plate 24 interposed therebetween). The fixed portion 70*a* is disposed in the region between a first positioning portion 42*a* and a first positioning portion 42*b* in plan view. That is, when viewed in the X direction, the first positioning portions 42*a* and 42*b* and the fixed portion 70*a* overlap at least partially. Thus, since the first positioning portion 42 and the fixed portion 70*a* do not overlap in the X direction and are overlapped in the Y direction, the size of the liquid ejecting head 3 in the Y direction can be further reduced.

As illustrated in FIG. 9, a recessed portion 75 having an inner peripheral surface 75*a* is provided at a position corresponding to the fixed portion 70*b* of the case head 17. The through-hole 85 is opened on the negative side of the recessed portion 75 in the Z direction, that is, on the upper ceiling surface. The inner diameter of the recessed portion 75 is set larger than the inner diameter (that is, opening diameter) of the through-hole 85. In addition, a cylindrical projection portion 76 protruding toward the case head 17 is provided at a position corresponding to the fixed portion 70*b* of the introduction path unit 18, that is, at the opening peripheral edge of the female screw portion 86. A communication hole 87 that communicates with the female screw portion 86 is formed inside the projection portion 76. The inner diameter of the communication hole 87 is set to be slightly larger than the inner diameter of the female screw portion 86, and the fixed member 39 is inserted into the communication hole 87. In addition, the outer diameter of the projection portion 76 is set to be the same as or slightly smaller than the inner diameter of the recessed portion 75.

In FIG. 9, although the configuration of one of the fixed portions 70*b* (right side (negative side) in FIG. 7) among the fixed portions 70*b* disposed in parallel in the X direction is illustrated, the other of the fixed portions 70*b* (left side (positive side) in FIG. 7) has the same configuration. The case head 17 and the introduction path unit 18 are positioned by inserting the projection portion 76 into the recessed portion 75 and fitting an outer peripheral surface 76*b* of the projection portion 76 with an inner peripheral surface 75*a* of the recessed portion 75. As described above, since the distance D2 in the X direction between the fixed portions 70*b* is longer than the distance D1 in the X direction between the fixed portions 70*a* , the positioning accuracy between the case head 17 and the introduction path unit 18 can be improved.

The circuit substrate 22 provided in the case head 17 is a relay substrate for receiving a drive signal from a control unit (not illustrated) and applying the drive signal to the piezoelectric element 31 through the wiring member 23 (refer to FIG. 10). The circuit substrate 22 protrudes from the case head 17 on both sides in the X direction, and connectors 40 for coupling to the control unit are provided on protruding portions. A flexible flat cable (FFC, not illustrated) is coupled to the connector 40, and a drive signal is received from the control unit side via the FFC.

Each of the fixed portions 70 is disposed at a position deviated to the upstream or the downstream in the Y direction than an outer periphery 80 of the nozzle plate 24 indicated by a broken line in FIGS. 4 and 7 in plan view viewed from the Z direction. On the other hand, each of the fixed portions 70 is positioned inside in the X direction than the outer periphery 80. Therefore, the connector 40 can be disposed without interfering with the fixed portion 70 at a position deviated to the positive side and the negative side in the X direction than the outer periphery 80 of the nozzle plate 24. Therefore, the size of the liquid ejecting head 3 in the X direction can be reduced as compared with the case where the fixed portion 70 is disposed at a position deviated to the outside in the X direction than the outer periphery 80 of the nozzle plate 24.

On the lower surface of the flange portion 21 of the case head 17, the first positioning portion 42 used for positioning the liquid ejecting head 3 is provided on one side in the Y direction, that is, on the downstream edge portion in the transport direction. More specifically, the first positioning portions 42 (42*a* , 42*b* ) are formed at both corners on the downstream of the lower surface of the flange portion 21, respectively. For example, these first positioning portions 42*a* and 42*b* are configured to include a recessed portion recessed from the lower surface of the flange portion 21 to the middle of the flange portion 21 in the thickness direction (that is, Z direction), or a through-hole penetrating the flange portion 21. In the present embodiment, these first positioning portions 42*a* and 42*b* are not used, and are used for positioning with respect to the first head holding member 60 according to second embodiment described later.

The introduction path unit 18 is a member in which an ink introduction path (not illustrated) for introducing the ink supplied from the liquid storage member side to the introduction liquid chamber 36 side of the case head 17 is formed inside. As illustrated in FIG. 7, the introduction path unit 18 is formed larger than the flange portion 21 of the case head 17 in plan view, and is laminated on the upper surface of the flange portion 21. In addition, as illustrated in FIG. 6, an attachment region 44 of the liquid storage member is partitioned on the upper surface of the introduction path unit 18. An upstream opening portion of the ink introduction path is opened in the attachment region 44, and a plurality of introduction needles 45 are attached to the opening portion through a filter (not illustrated). In the present embodiment, two rows of five introduction needles 45 disposed in parallel in the X direction are formed in two rows in the Y direction, that is, a total of ten introduction needles 45 are provided upright. These introduction needles 45 are members that are inserted into the liquid storage member attached to the attachment region 44 and for introducing the ink stored in the liquid storage member into the liquid ejecting unit 19 side. Each of the introduction needles 45 has a hollow needle shape, and an introduction hole is formed at the tip end portion. In addition, a base side of the introduction needle 45 has a hem-expanding shape that increases in diameter toward the downstream opening. The configuration in which the introduction path unit 18 introduces the ink is not limited to the configuration using such a needle-shaped introduction needle 45. For example, it is also possible to adopt a so-called foam type configuration in which a porous material such as a nonwoven fabric or sponge is disposed in the ink introduction portion of the introduction path unit 18, a similar porous material is also provided in the ink outlet portion of the liquid storage member correspondingly, and both porous members are in contact with each other to exchange liquid by capillary phenomenon.

Screw holes 46 through which male screw portions of a fixed member 48 (refer to FIG. 3) such as a screw or a bolt (not illustrated) used for fixing to the second head holding member 4 are inserted are respectively formed in the corners of the four corners of the introduction path unit 18 so as to penetrate through the thickness direction of the introduction path unit 18, that is, the Z direction. In FIG. 3, only the male screw portion of the fixed member 48 is illustrated in cross section. Among these screw holes 46, one screw hole 46*a* of the two screw holes 46 (left side in FIG. 7) positioned on the downstream of the introduction path unit 18 in the Y direction is a circular through-hole that is slightly larger than the outer diameter of a male screw portion of fixed member 48, and is configured such that a slight gap is formed between the screw hole 46*a* and the male screw portion. The screw hole 46*a* is disposed at a position closest to a second positioning portion 43 described later. In FIG. 7, the screw holes 46*b* , 46*c* , and 46*d* respectively disposed at the corners of the introduction path unit 18 clockwise from the screw hole 46*a* are long holes having a short diameter aligned with the diameter of the screw hole 46*a* and a long diameter set longer than the diameter of the screw hole 46*a* . Each of the screw holes 46*b* , 46*c* , and 46*d* is formed so that the direction of the long diameter thereof is normally along a circumferential direction of a virtual circle with a second positioning portion 43 described later as the center. That is, when the liquid ejecting head 3 is fixed to the second head holding member 4 by inserting the male screw portion of the fixed member 48 into the screw holes 46, within the range of the gap formed between each of the screw holes 46*a* to 46*d* and the male screw portion of the fixed member 48 inserted therein, the position of the liquid ejecting head 3 with respect to the second head holding member 4 can be finely adjusted in the circumferential direction of the virtual circle with the second positioning portion 43 as the center. The position adjustment of the liquid ejecting head 3 is performed by an adjustment mechanism 47 provided on the second head holding member 4. This point will be described later.

As illustrated in FIG. 7, on the lower surface of the introduction path unit 18, the second positioning portion 43 used for positioning with respect to the second head holding member 4 is provided at a portion extending to the downstream (positive side) in the Y direction than the flange portion 21 of the case head 17, and at a position shifted toward the screw hole 46*a* side in the X direction. The second positioning portion 43 serves as a rotation center at the time of position adjustment by the adjustment mechanism 47 described later. Regarding the positional relationship between the second positioning portion 43 and the first positioning portion 42, the first positioning portion 42 is disposed at a position closer to the nozzle formation surface than the second positioning portion 43 in the Y direction which is the transport direction. In addition, the first positioning portion 42 is disposed at a position closer to the nozzle formation surface than the second positioning portion 43 in the Z direction, which is a direction orthogonal to the nozzle formation surface. That is, when positioning the liquid ejecting head 3 and the head holding member (first head holding member 60 described later), positioning by using the first positioning portion 42 positioned closer to the nozzle formation surface in the Y direction and the Z direction can define the position of the nozzle formation surface with higher accuracy. In the present embodiment, although the liquid ejecting head 3 and the second head holding member 4 are positioned by using the second positioning portion 43, as described below, by adopting a configuration in which the position of the liquid ejecting head 3 with respect to the second head holding member 4 is adjusted by the adjustment mechanism 47, the inclination of the nozzle formation surface in the X direction and the Y direction can be adjusted with higher accuracy. Therefore, the positional accuracy of the nozzle formation surface, that is, the positional accuracy of each of the nozzles 29 can be ensured.

In the present embodiment, although the configuration in which only one second positioning portion 43 is formed is exemplified, the configuration is not limited thereto, and on the lower surface of the introduction path unit 18, in the portion extending to the downstream in the Y direction than the flange portion 21 of the case head 17, a configuration in which a second positioning portion 43' (portion indicated by a broken line in FIG. 7) is provided close to the screw hole 46*b* side may be employed, in addition to the second positioning portion 43 on the screw hole 46*a* side in the X direction. In this case, in the manufacturing step of the liquid ejecting head 3, for example, these two second positioning portions 43 can be used to position with a jig or the like.

The second head holding member 4 according to the present embodiment is a box-shaped member with an open upper surface that includes a bottom plate 51 and side walls 52 provided upright from the periphery of the bottom plate 51 and surrounding the four sides of the bottom plate 51. A space partitioned by these bottom plate 51 and the side wall 52 functions as an accommodation empty portion 16 that accommodates the liquid ejecting head 3. The upper surface of the bottom plate 51 (that is, surface on the accommodation empty portion 16 side) functions as a head placement portion and is a portion on which the liquid ejecting head 3 is placed. The bottom plate 51 is provided with an insertion port 53. The insertion port 53 is a through-hole having a size into which the case main body 20 of the liquid ejecting head 3 can be inserted and into which the introduction path unit 18 cannot be inserted. When the liquid ejecting head 3 is accommodated and attached in the accommodation empty portion 16 of the second head holding member 4, the case main body 20 is inserted into the insertion port 53 and protrudes outward (downward) than the bottom plate 51 of the second head holding member 4. The lower surface of the introduction path unit 18 of the liquid ejecting head 3 is seated on the bottom plate 51 of the second head holding member 4 so that the position of the liquid ejecting head 3 in the second head holding member 4 in the Z direction is defined. For example, a configuration can be adopted in which the position of the liquid ejecting head 3 in the Z direction is defined by contacting the lower surface of the introduction path unit 18 with a protruding portion such as a boss protruding upward from the bottom plate 51 in the Z direction.

In addition, although not illustrated, the bottom plate 51 of the second head holding member 4 is formed with a total of four female screw portions corresponding to each of the screw holes 46*a* to 46*d* on the liquid ejecting head 3 side. When the liquid ejecting head 3 is fixed to the second head holding member 4, the male screw portion of the fixed member 48 is inserted from the screw holes 46*a* to 46*d* side of the liquid ejecting head 3 and screwed into the female screw portion of the bottom plate 51. Therefore, the liquid ejecting head 3 can be screwed to the second head holding member 4. These female screw portions can adopt a configuration formed inside a member such as a boss for positioning in the Z direction. Furthermore, on the upper surface of the bottom plate 51, a protrusion 55 protruding upward from the bottom plate 51 in the Z direction is formed at a position corresponding to the second positioning portion 43 of the liquid ejecting head 3. The case main body 20 of the liquid ejecting head 3 is inserted into the insertion port 53 and the protrusion 55 is inserted into the second positioning portion 43. Therefore, the arrangement position of the liquid ejecting head 3 with respect to the second head holding member 4, that is, the position of the nozzle formation surface, more specifically, the position of each of the nozzles 29 in the X direction and the Y direction can be normally defined. The protrusion 55 is disposed at a position farther from the nozzle formation surface than the first positioning portion 42 of the liquid ejecting head 3 held by the second head holding member 4 in the Y direction.

Furthermore, the bottom plate 51 of the second head holding member 4 is provided with the adjustment mechanism 47 for adjusting the arrangement position of the liquid ejecting head 3. For example, the adjustment mechanism 47 according to the present embodiment is configured to include an eccentric cam, is provided at a position where the adjustment mechanism 47 can come into contact with the end surface of the liquid ejecting head 3 disposed on the bottom plate 51 on the downstream in the Y direction (for example, end surface of the introduction path unit 18 on the downstream in the Y direction), and at a position where the second positioning portion 43 and the protrusion 55 are shifted to the opposite side across the center of the liquid ejecting head 3 in the X direction (for example, position on the screw hole 46*b* side). In addition, the end surface of the liquid ejecting head 3 disposed on the bottom plate 51 on the upstream in the Y direction is biased toward the adjustment mechanism 47 side, that is, the downstream by a biasing member 56 such as a spring. The adjustment mechanism 47 is not limited to the illustrated eccentric cam, and various configurations can be adopted as long as the position of the liquid ejecting head 3 can be adjusted. For example, a configuration can be adopted in which the position of the liquid ejecting head 3 is adjusted by the tightening amount of the adjusting screw in a state where the tip end portion is in contact with the liquid ejecting head 3.

When the liquid ejecting head 3 is attached to the second head holding member 4 in the manufacturing step of the liquid ejecting apparatus 1, the case main body 20 of the liquid ejecting head 3 is inserted into the insertion port 53 of the second head holding member 4, and the protrusion 55 of the second head holding member 4 is inserted into the second positioning portion 43 of the liquid ejecting head 3. Therefore, when the lower surface of the introduction path unit 18 is seated on the bottom plate 51 of the second head holding member 4, the liquid ejecting head 3 is roughly positioned on the second head holding member 4. In addition, in this state, as described above, the liquid ejecting head 3 is biased toward the adjustment mechanism 47 by the biasing member 56. Next, the male screw portion of the fixed member 48 is inserted into each of the screw holes 46, and the fixed member 48 is screwed into the female screw portion of the second head holding member 4 to such an extent that the liquid ejecting head 3 can be moved somewhat with respect to the second head holding member 4. Therefore, the liquid ejecting head 3 is temporarily fixed to the second head holding member 4. In this state, the position of the liquid ejecting head 3 is adjusted by the adjustment mechanism 47. In the present embodiment, the position of the liquid ejecting head 3 with respect to the second head holding member 4, in particular, the inclination of the nozzle formation surface with respect to the X direction and the Y direction is adjusted by rotating the adjustment mechanism 47 as the eccentric cam. In other words, when the adjustment mechanism 47 is rotated, the cam diameter from the rotation center to the outer peripheral surface in contact with the introduction path unit 18 increases or decreases. As a result, as described above, the position of the liquid ejecting head 3 can be finely adjusted around the second positioning portion 43. In this position adjustment, for example, the ink is ejected from each of the nozzles 29 onto the medium 2 to print a test pattern such as a ruled line, and based on the test pattern, the position adjustment can be performed using the adjustment mechanism 47 so that each of the nozzle rows 28 on the nozzle formation surface is parallel to the Y direction, that is, the ruled lines of the test pattern are aligned in the Y direction. When the position adjustment is completed, the liquid ejecting head 3 is permanently fixed to the second head holding member 4 by tightening the fixed member 48.

As described above, in the present embodiment, even with a configuration in which the liquid ejecting head 3 and the second head holding member 4 are positioned by using the second positioning portion 43 with lower positioning accuracy than that of the first positioning portion 42, the position of each of the nozzles on the nozzle formation surface can be adjusted with higher accuracy by having the adjustment mechanism 47. In addition, according to the configuration of the present embodiment, since positioning is performed using the second positioning portion 43 positioned at a position farther from the nozzle formation surface in the Z direction than the first positioning portion 42 (in other words, further separated position), as illustrated in FIG. 2, a space below the portion where the first positioning portion 42 is provided can be used as an arrangement space for a roller of the transport mechanism 6, that is, the second roller 9 on the downstream in the present embodiment. As a result, distance (inter-axial distance) La (equivalent to the second distance in the present disclosure) between the first roller 8 and the second roller 9 can be shortened. More specifically, the second roller 9 on the downstream is disposed at a position closer to the nozzle formation surface than the second positioning portion 43 in the Y direction. As a result, the transport accuracy of the medium 2 is increased, and the landing accuracy of the liquid on the medium 2 can be further improved. In addition, in the present embodiment, since the position of each of the nozzles on the nozzle formation surface can be adjusted with higher accuracy by having the adjustment mechanism 47, the liquid landing accuracy on the medium 2 can be further improved. Therefore, it contributes to the improvement of the image quality of the image printed and recorded on the medium 2.

Figure 11:
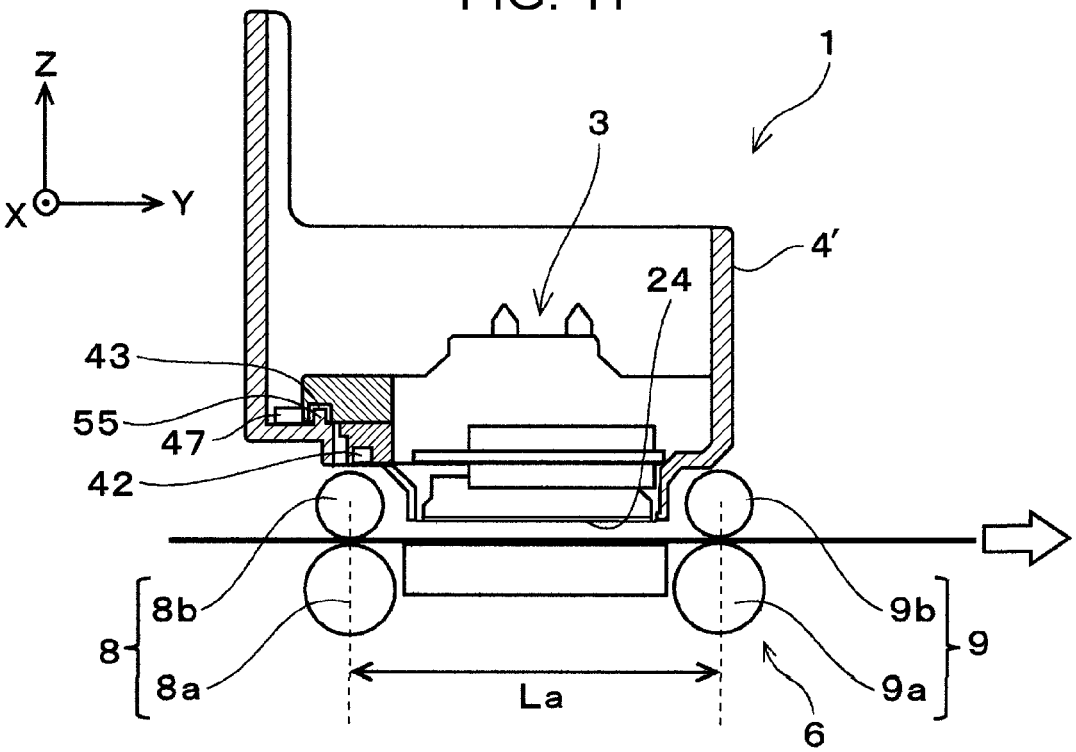
FIG. 11 is a side view of a periphery of a liquid ejecting head for describing a modification of the first embodiment.

FIG. 11 is a side view of a peripheral configuration of the liquid ejecting head 3 for describing a modification of the first embodiment. In the above embodiment, although the configuration in which the first positioning portion 42 and the second positioning portion 43 are provided on the downstream than the nozzle formation surface in the Y direction is illustrated, it is not limited thereto. A configuration may be adopted in which the first positioning portion 42 and the second positioning portion 43 are provided on the upstream than the nozzle formation surface in the Y direction as in the modification. In this configuration, the first roller 8 on the upstream is disposed at a position closer to the nozzle formation surface than the second positioning portion 43 in the Y direction. Other configurations are the same as those in the first embodiment. Even in this configuration, the transport accuracy of the medium 2 can be increased. In addition, since the position of each of the nozzles on the nozzle formation surface can be adjusted with higher accuracy by the adjustment mechanism 47, the liquid landing accuracy on the medium 2 can be further improved. Therefore, it contributes to the improvement of the image quality of the image printed and recorded on the medium 2.

Figure 12:
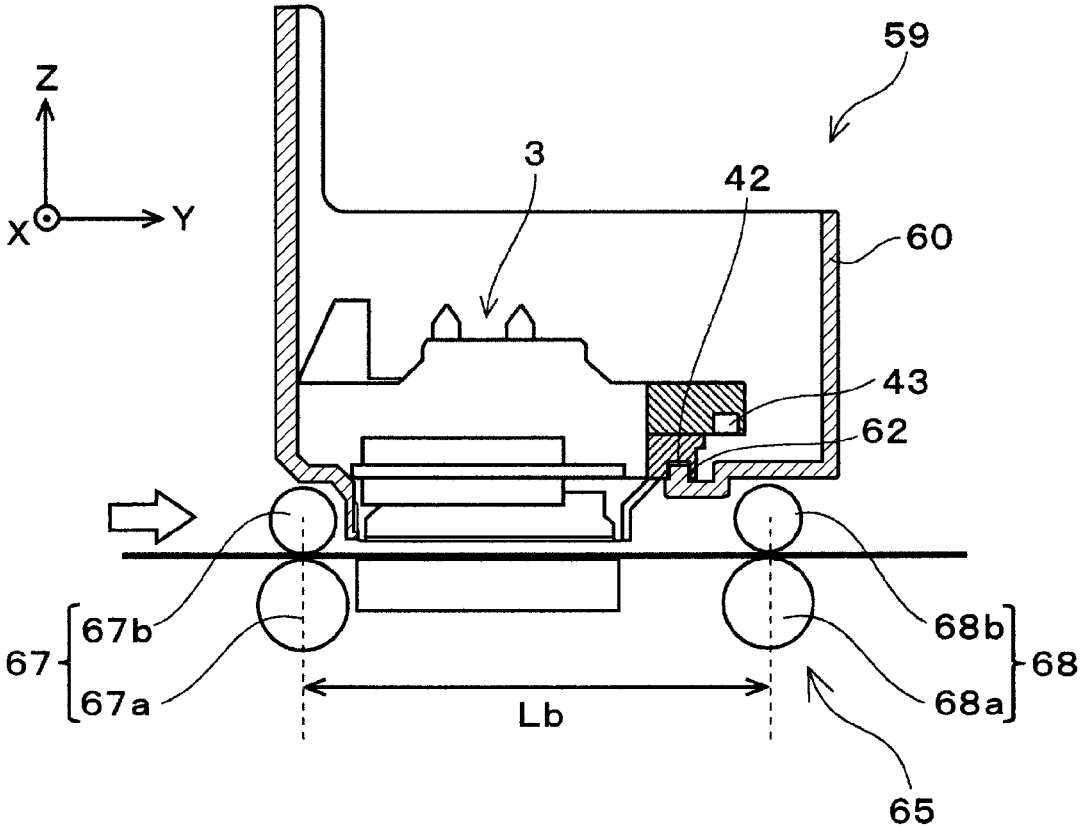
FIG. 12 is a side view illustrating a configuration of a periphery of a liquid ejecting head according to a second embodiment.
Figure 13:
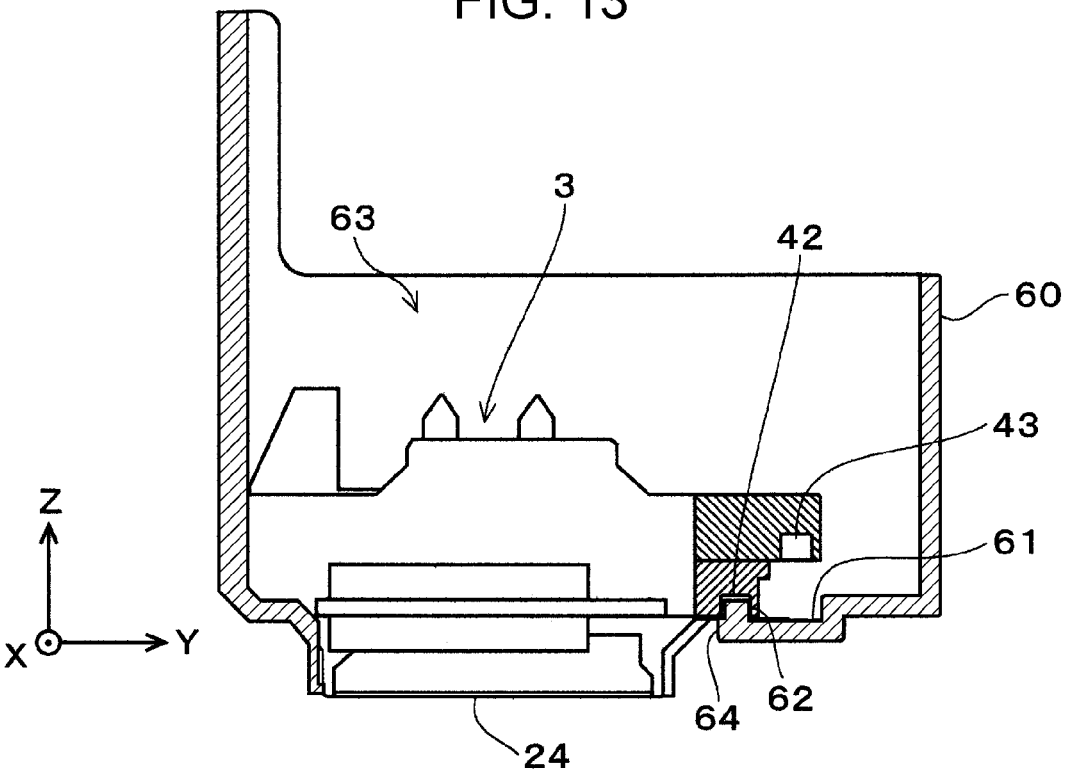
FIG. 13 is a cross-sectional view illustrating a configuration of an aspect of a first head holding member according to the second embodiment.

FIG. 12 is a side view of a peripheral configuration of the liquid ejecting head 3 in the liquid ejecting apparatus 59 of the second embodiment. In addition, FIG. 13 is a view illustrating a state where the liquid ejecting head 3 is attached to the first head holding member 60 according to the second embodiment. The first head holding member 60 according to the present embodiment is different from the second head holding member 4 in the first embodiment in that a protrusion 62 that can be inserted into the first positioning portion 42 is provided at a position corresponding to the first positioning portion 42 of the liquid ejecting head 3 in a bottom plate 61 that functions as a head placement portion. In other words, in the present embodiment, the first head holding member 60 is positioned by using the first positioning portion 42 provided in the case head 17 that is the first member of the liquid ejecting head 3. The protrusion 62 of the first head holding member 60 is disposed at a position closer to the nozzle formation surface than the second positioning portion 43 of the liquid ejecting head 3 accommodated in the first head holding member 60. In the present embodiment, when the liquid ejecting head 3 is accommodated and attached in the accommodation empty portion 63 of the first head holding member 60, the case main body 20 is inserted into an insertion port 64, and the protrusion 62 is inserted into the first positioning portion 42. Therefore, when the lower surface of the flange portion 21 of the case head 17 in the liquid ejecting head 3 is seated on the bottom plate 61 of the first head holding member 60, the arrangement position of the liquid ejecting head 3 with respect to the first head holding member 60 is defined. As described above, the first positioning portion 42 is disposed at a position closer to the nozzle formation surface than the second positioning portion 43 in each of the Y direction and the Z direction. Therefore, when positioning the liquid ejecting head 3 and the first head holding member 60, the position of the nozzle formation surface can be defined with higher accuracy, that is, positioning can be performed as compared with the case where the second positioning portion 43 is used. Therefore, the first head holding member 60 according to the present embodiment is not provided with the adjustment mechanism 47 according to the first embodiment.

Similar to the transport mechanism 6 in the first embodiment, a transport mechanism 65 according to the present embodiment is provided with a first roller 67 including a pair of upper and lower rollers 67*a* and 67*b* positioned on the upstream than the nozzle formation surface of the liquid ejecting head 3 mounted on the first head holding member 60 in the Y direction, and a second roller 68 including a pair of upper and lower rollers 68*a* and 68*b* positioned on the downstream than the nozzle formation surface. The first roller 67 is a roller on the upstream in the Y direction than the nozzle formation surface and is disposed at a position closest to the nozzle formation surface among the rollers included in the transport mechanism 65. Similarly, the second roller 68 is a roller on the downstream in the Y direction than the nozzle formation surface and is disposed at a position closest to the nozzle formation surface. In the liquid ejecting apparatus 59 in which the liquid ejecting head 3 is mounted on the first head holding member 60, the liquid ejecting head 3 and the first head holding member 60 are positioned by using the first positioning portion 42. Therefore, in the first head holding member 60, since the bottom plate 61 and the protrusion 62 are disposed below in the Z direction than the lower surface of the flange portion 21 of the liquid ejecting head 3, that is, on the medium 2 side during printing, the distance from the lower surface of the bottom plate 61 of the first head holding member 60 to the medium 2 during printing is narrower than the second head holding member 4.

Here, the distance (in other words, gap) from the medium 2 to the nozzle formation surface is set to a predetermined value, and in recent years, the height of the case head 17 tends to be lowered as the liquid ejecting head 3 is downsized. Therefore, in the present embodiment, when the second roller 68 on the downstream among the first roller 67 and the second roller 68 of the transport mechanism 65 is arranged below the portion where the first positioning portion 42 of the liquid ejecting head 3 is provided in the first head holding member 60, the second roller 68 cannot be disposed at this position because the second roller 68 interferes with the first head holding member 60. In the present embodiment, in order to avoid interference with the first head holding member 60, the second roller 68 is positioned at a position farther from the nozzle formation surface (that is, closer to downstream) than the first positioning portion 42 in the Y direction. As a result, compared to the distance La between the first roller 8 and the second roller 9 in the transport mechanism 6 according to the first embodiment, the distance Lb (corresponding to the first distance in the disclosure) between the first roller 67 and the second roller 68 according to the present embodiment is increased. Therefore, in the present embodiment, although the transport accuracy of the medium 2 is lower than in the first embodiment, a configuration is adopted in which the liquid ejecting head 3 and the first head holding member 60 are positioned by using the first positioning portion 42. Therefore, the position of each of the nozzles on the nozzle formation surface can be adjusted with higher accuracy. As a result, also in the present embodiment, the landing accuracy of the liquid in the medium 2 can be ensured. In addition, in the present embodiment, the adjustment mechanism 47 is unnecessary, which contributes to reducing the size and cost of the first head holding member 60.

Figure 14:
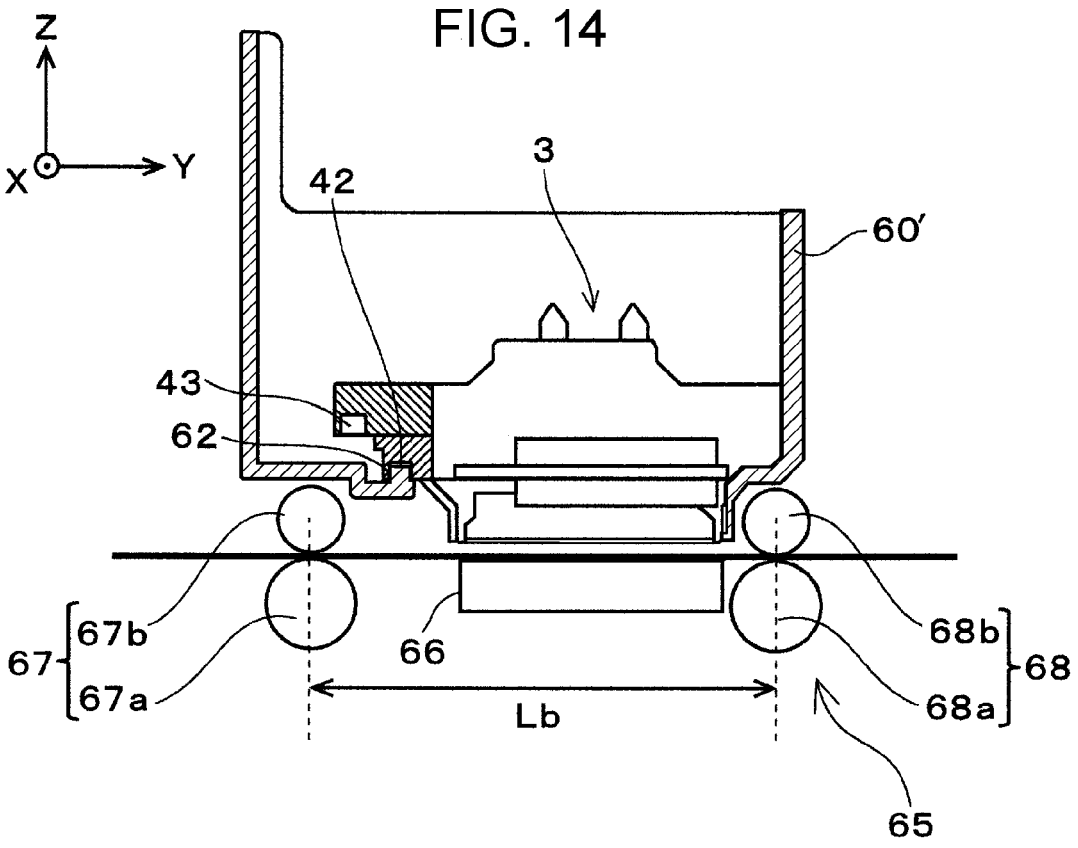
FIG. 14 is a side view of a periphery of a liquid ejecting head for describing a modification of the second embodiment.

FIG. 14 is a side view of a peripheral configuration of the liquid ejecting head 3 for describing a modification of the second embodiment. Also in the present embodiment, similar to the modification of the first embodiment, a configuration can be adopted in which the first positioning portion 42 and the second positioning portion 43 are provided on the upstream than the nozzle formation surface in the Y direction. In this configuration, the first roller 67 on the upstream is disposed at a position farther from the nozzle formation surface than the second positioning portion 43 in the Y direction. Other configurations are the same as those in the second embodiment. Also in the present embodiment, since the configuration is adopted in which the liquid ejecting head 3 and the second head holding member 4 are positioned by using the first positioning portion 42, the position of each of the nozzles on the nozzle formation surface can be adjusted with higher accuracy.

As described above, at the time of manufacturing the liquid ejecting apparatus 1 in which the distance between the first roller 67 and the second roller 68 is set to the second distance La, and which includes the second head holding member 4 having the protrusion 55 at a position corresponding to the second positioning portion 43, when holding the liquid ejecting head 3 on the second head holding member 4, the liquid ejecting head 3 and the second head holding member 4 are positioned by using the second positioning portion 43, and the position of the nozzle formation surface is adjusted by using the adjustment mechanism 47. In addition, at the time of manufacturing the liquid ejecting apparatus 59 in which the distance between the first roller 67 and the second roller 68 is set to the first distance Lb, and which includes the first head holding member 60 having the protrusion 62 at a position corresponding to the first positioning portion 42, when holding the liquid ejecting head 3 on the first head holding member 60, the liquid ejecting head 3 and the first head holding member 60 are positioned by using the first positioning portion 42. Therefore, the liquid ejecting head 3 according to the present disclosure can be applied to a plurality of types of liquid ejecting apparatuses having different specifications without structural changes.

Figure 15:
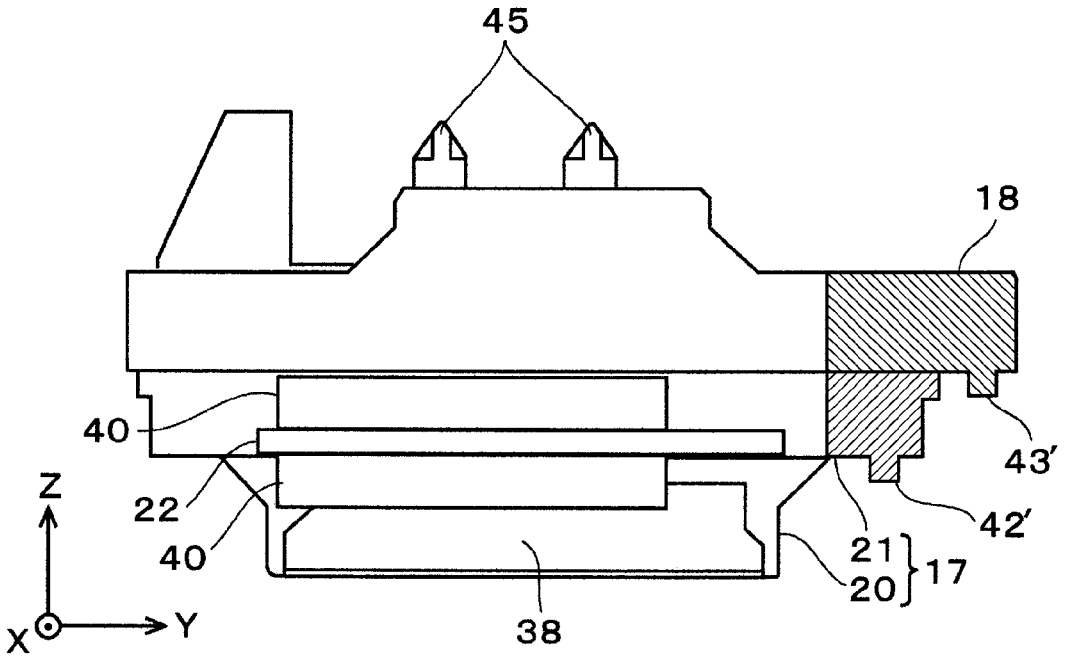
FIG. 15 is a side view illustrating a configuration of a liquid ejecting head for describing a modification of the first embodiment and the second embodiment.

FIG. 15 is a side view illustrating a modification of the liquid ejecting head 3 according to the first embodiment and the second embodiment. In each of the above embodiments, although the configuration is illustrated in which the liquid ejecting head 3 and the head holding members 4 and 60 are respectively positioned by inserting the protrusions 55 and 62 of the head holding members 4 and 60 into the first positioning portion 42 and the second positioning portion 43 which are formed as the recessed portion or the through-hole, the configuration is not limited thereto as long as the liquid ejecting head 3 and the head holding members 4 and 60 can be positioned. For example, as illustrated in FIG. 15, the first positioning portion 42' and the second positioning portion 43' may be configured to include the protrusion, respectively. In this case, the second head holding member 4 is provided with the recessed portion or the through-hole into which the second positioning portion 43' can be inserted at a position farther from the nozzle formation surface than the first positioning portion 42' in the Y direction. The head holding member 60 is provided with the recessed portion or the through-hole into which the second positioning portion 43' can be inserted at a position closer to the nozzle formation surface than the second positioning portion 43' in the Y direction. In short, various configurations can be adopted as long as the configuration allows positioning with respect to the head holding member of the liquid ejecting apparatus having different specifications.

In each of the above embodiments, although the case head 17 is illustrated as the first member in the present disclosure, and the introduction path unit 18 is illustrated as the second member in the present disclosure, the disclosure is not limited thereto. Among the constituent members constituting the liquid ejecting head, a configuration may be used in which the first positioning portion is provided on the first member disposed closer to the nozzle formation surface, and the second positioning portion is provided on the second member disposed farther from the nozzle formation surface in the Z direction. By adopting such a configuration, compared with the case where the second positioning portion is used, when the liquid ejecting head and the first head holding member are positioned by using the first positioning portion, the nozzle formation surface can be positioned with higher accuracy.

Hereinbefore, the ink jet type liquid ejecting head is described as an example of the liquid ejecting head. The present disclosure can also be applied to another liquid ejecting head mounted on a head holding member of a liquid ejecting apparatus including a first roller disposed on the upstream in the transport direction and a second roller disposed on the downstream in the transport direction of the medium, and a liquid ejecting apparatus including the same. For example, the present disclosure can also be applied to a liquid ejecting head including a plurality of ejecting heads such as a color material ejecting head used in manufacturing of a color filter such as a liquid crystal display, an electrode material ejection head used for electrode formation of organic electro luminescence (EL) display, a field emission display (FED), and a bioorganic matter ejecting head used in manufacturing of a biochip (biochemical element), and a liquid ejecting apparatus including the same.

Hereinafter, the technical idea grasped from the embodiment and the modification described above and the operation and effect thereof will be described.

The liquid ejecting head of the present disclosure, which is mounted on the liquid ejecting apparatus including the first roller disposed on the upstream in the transport direction of the medium and the second roller disposed on the downstream in the transport direction, and which ejects the liquid onto the medium transported by the first roller and the second roller, the liquid ejecting head includes the nozzle formation surface provided with the nozzle ejecting the liquid, and disposed between the first roller and the second roller in the transport direction, the first positioning portion used for positioning with respect to the first head holding member provided in the liquid ejecting apparatus in which the distance between the first roller and the second roller in the transport direction is set to the first distance, and the second positioning portion used for positioning with respect to the second head holding member provided in the liquid ejecting apparatus in which the distance between the first roller and the second roller in the transport direction is set to the second distance shorter than the first distance (first configuration).

Since the liquid ejecting head according to the present disclosure includes the first positioning portion and the second positioning portion, the liquid ejecting head can be applied to a plurality of types of liquid ejecting apparatuses having different specifications without structural changes.

In the first configuration, it is desirable to adopt a configuration in which the distance between the first positioning portion and the nozzle formation surface is shorter than the distance between the second positioning portion and the nozzle formation surface in the transport direction (second configuration).

According to this configuration, the first head holding member and the liquid ejecting head are positioned by using the first positioning portion closer to the nozzle formation surface in the transport direction, so that the position of the nozzle formation surface can be positioned with higher accuracy.

In the first configuration, it is desirable to adopt a configuration in which the distance between the first positioning portion and the nozzle formation surface is shorter than the distance between the second positioning portion and the nozzle formation surface in the direction orthogonal to the nozzle formation surface (third configuration).

According to this configuration, the first head holding member and the liquid ejecting head are positioned by using the first positioning portion closer to the nozzle formation surface in the direction orthogonal to the nozzle formation surface, so that the position of the nozzle formation surface can be positioned with higher accuracy.

In the first configuration, it is desirable to adopt a configuration in which the liquid ejecting head further includes the first member provided with the first positioning portion, and the second member provided with the second positioning portion, in which the nozzle formation surface is disposed closer to the first member than the second member in the direction orthogonal to the nozzle formation surface (fourth configuration).

According to this configuration, since the first positioning portion is provided on the first member closer to the nozzle formation surface, compared with the case where the second positioning portion is used, when the liquid ejecting head and the first head holding member are positioned by using the first positioning portion, the nozzle formation surface can be positioned with higher accuracy.

In addition, the liquid ejecting apparatus of the disclosure includes the liquid ejecting head according to the first configuration, and the second head holding member on which the liquid ejecting head is mounted, and that includes the adjustment mechanism adjusting the position of the nozzle formation surface (fifth configuration).

According to this configuration, the liquid ejecting head can be mounted on the second head holding member without structural changes. In addition, since the position of the nozzle formation surface can be adjusted by the adjustment mechanism in the state of positioning by using the second positioning portion, the nozzle formation surface can be positioned with higher accuracy.

In addition, in the fifth configuration, a configuration can be adopted in which the first roller and the second roller are provided, the first positioning portion and the second positioning portion are disposed on the upstream than the nozzle formation surface in the transport direction, the distance between the first roller and the nozzle formation surface is shorter than the distance between the second positioning portion and the nozzle formation surface in the transport direction (sixth configuration).

Alternatively, in the fifth configuration, a configuration can be adopted in which the first roller and the second roller are provided, the first positioning portion and the second positioning portion are disposed on the downstream than the nozzle formation surface in the transport direction, the distance between the second roller and the nozzle formation surface is shorter than the distance between the second positioning portion and the nozzle formation surface in the transport direction (seventh configuration).

In the fifth configuration, a configuration can be adopted in which the second head holding member is provided with the protrusion, the second positioning portion is the recessed portion or the through-hole into which the protrusion is inserted, and the distance between the protrusion and the nozzle formation surface is longer than the distance between the first positioning portion and the nozzle formation surface in the transport direction (eighth configuration).

According to this configuration, the liquid ejecting head and the second head holding member can be positioned by using the second positioning portion.

In addition, in the fifth configuration, a configuration can be adopted in which the second head holding member is provided with the recessed portion or the through-hole, the second positioning portion is the protrusion inserted into the recessed portion or the through-hole, the distance between the recessed portion or the through-hole and the nozzle formation surface is longer than the distance between the first positioning portion and the nozzle formation surface in the transport direction (ninth configuration).

According to this configuration, the liquid ejecting head and the second head holding member can be positioned by using the second positioning portion.

In addition, the liquid ejecting apparatus of the present disclosure includes the liquid ejecting head according to the first configuration, and the first head holding member on which the liquid ejecting head is mounted (tenth configuration).

According to this configuration, the liquid ejecting head can be mounted on the first head holding member without structural changes. In addition, since the liquid ejecting head and the first head holding member can be positioned by using the first positioning portion disposed at a position closer to the nozzle formation surface than the second positioning portion, the nozzle formation surface can be positioned with higher accuracy. In addition, since the adjustment mechanism is unnecessary as compared with the configuration in which the liquid ejecting head and the second head holding member are positioned by using the second positioning portion, it contributes to downsizing of the first head holding member and also contributes to cost reduction.

In the tenth configuration, a configuration can be adopted in which the first roller and the second roller are provided, the first positioning portion and the second positioning portion are disposed on the upstream than the nozzle formation surface in the transport direction, the distance between the first roller and the nozzle formation surface is longer than the distance between the first positioning portion and the nozzle formation surface in the transport direction (eleventh configuration).

Alternatively, in the tenth configuration, a configuration can be adopted in which the first roller and the second roller are provided, the first positioning portion and the second positioning portion are disposed on the downstream than the nozzle formation surface in the transport direction, the distance between the second roller and the nozzle formation surface is longer than the distance between the first positioning portion and the nozzle formation surface in the transport direction (twelfth configuration).

In the tenth configuration, the first head holding member is provided with the protrusion, the first positioning portion is the recessed portion or the through-hole into which the protrusion is inserted, the distance between the protrusion and the nozzle formation surface is shorter than the distance between the second positioning portion and the nozzle formation surface in the transport direction (thirteenth configuration).

According to this configuration, the liquid ejecting head and the first head holding member can be positioned by using the first positioning portion.

Alternatively, in the tenth configuration, a configuration can be adopted in which the first head holding member is provided with the recessed portion or the through-hole, the first positioning portion is the protrusion inserted into the recessed portion or the through-hole, the distance between the protrusion and the nozzle formation surface is shorter than the distance between the second positioning portion and the nozzle formation surface in the transport direction (fourteenth configuration).

According to this configuration, the liquid ejecting head and the first head holding member can be positioned by using the first positioning portion.

In addition, a method of manufacturing the liquid ejecting apparatus of the present disclosure is a method of manufacturing the liquid ejecting apparatus according to the fifth configuration, the method includes positioning the liquid ejecting head and the first head holding member by using the first positioning portion, when the liquid ejecting head is held on the first head holding member, and positioning the liquid ejecting head and the second head holding member by using the second positioning portion, when the liquid ejecting head is held on the second head holding member (first method).

According to the present disclosure, since the liquid ejecting head includes the first positioning portion and the second positioning portion, the liquid ejecting head can be applied to the plurality of types of liquid ejecting apparatuses having different specifications without structural changes.

In addition, a method of manufacturing the liquid ejecting apparatus of the present disclosure is a method of manufacturing the liquid ejecting apparatus according to the tenth configuration, the method includes positioning the liquid ejecting head and the first head holding member by using the first positioning portion, when the liquid ejecting head is held on the first head holding member, and positioning the liquid ejecting head and the second head holding member by using the second positioning portion, when the liquid ejecting head is held on the second head holding member (second method).

According to the present disclosure, since the liquid ejecting head includes the first positioning portion and the second positioning portion, the liquid ejecting head can be applied to the plurality of types of liquid ejecting apparatuses having different specifications without structural changes.

What is claimed is:

1. A liquid ejecting head that is configured to be mounted on any one of a plurality of different liquid ejecting apparatuses, each of the plurality of apparatuses including a first roller and a second roller disposed on a downstream with respect to the first roller in a medium transport direction of a medium, and each of the plurality of apparatuses ejecting a liquid onto the medium transported by the respective first roller and the respective second roller, the liquid ejecting head comprising:

a nozzle formation surface including a nozzle for ejecting a liquid, and, when mounted on any of the plurality of apparatuses, is disposed in the medium transport direction between the first roller and the second roller of the mounted apparatus;

a first positioning portion configured to be used if mounting the liquid ejecting head to a first apparatus in which a distance between the first roller and the second roller of the first apparatus is a first distance in the medium transport direction, the first position portion also configured, if mounting the liquid ejecting head to the first apparatus, to position the liquid ejecting head with respect to a first head holding member of the first apparatus; and a second positioning portion configured to be used if mounting the liquid ejecting head to a second apparatus in which a distance between the first roller and the second roller of the second apparatus is a second distance in the medium transport direction, the second distance being different than the first direction, the second positioning portion also configured, if mounting the liquid ejecting head to the second apparatus, to position the liquid ejecting head with respect to a second head holding member of the second apparatus.

2. The liquid ejecting head according to claim 1, wherein a distance between the first positioning portion and the nozzle formation surface is shorter than a distance between the second positioning portion and the nozzle formation surface in the medium transport direction.

3. The liquid ejecting head according to claim 1, wherein a distance between the first positioning portion and the nozzle formation surface is shorter than a distance between the second positioning portion and the nozzle formation surface in a direction orthogonal to the nozzle formation surface.

4. The liquid ejecting head according to claim 1, further comprising:

a first member provided with the first positioning portion; and a second member provided with the second positioning portion, wherein the nozzle formation surface is disposed closer to the first member than to the second member in a direction orthogonal to the nozzle formation surface.

5. A liquid ejecting apparatus comprising:

a first roller;

a second roller, the first roller and the second roller configured to transport a medium in a medium transport direction, the second roller being disposed downstream of the first roller in the medium transport direction, a distance in the medium transport direction between the first roller and the second roller being a second distance that is shorter than a first distance;

a liquid ejecting head disposed in the medium transport direction between the first roller and the second roller, the liquid ejecting head configured to eject a liquid onto a medium transported by the first roller and the second roller; and a head holding member mounting the liquid ejecting head to the liquid ejecting apparatus, the liquid ejecting head comprising:

a nozzle formation surface including a nozzle for ejecting a liquid;

a second positioning portion mounting the liquid ejecting head to the liquid ejecting apparatus in which the distance in the medium transport direction between the first roller and the second roller is the second distance in the medium transport direction, the second positioning portion also positioning the liquid ejecting head with respect to the head holding member; and a first positioning portion configured to be used if mounting the liquid ejecting head to another liquid ejecting apparatus between a first roller and a second roller used to transport a medium in a medium transport of the other liquid ejecting apparatus, and in which a distance in the medium transport direction of the other liquid ejecting apparatus between the first roller and the second roller of the other liquid ejecting apparatus is the first distance.

6. The liquid ejecting apparatus according to claim 5, the head holding member including an adjustment mechanism adjusting a position of the nozzle formation surface.

7. The liquid ejecting apparatus according to claim 5, wherein the first positioning portion and the second positioning portion are disposed on an upstream than the nozzle formation surface in the medium transport direction, and a distance between the first roller and the nozzle formation surface is shorter than a distance between the second positioning portion and the nozzle formation surface in the medium transport direction.

8. The liquid ejecting apparatus according to claim 5, wherein the first positioning portion and the second positioning portion are disposed on a downstream than the nozzle formation surface in the medium transport direction, and a distance between the second roller and the nozzle formation surface is shorter than a distance between the second positioning portion and the nozzle formation surface in the medium transport direction.

9. The liquid ejecting apparatus according to claim 5, wherein, the head holding member is provided with a protrusion, the second positioning portion includes a recessed portion or a through-hole into which the protrusion is inserted, and a distance between the protrusion and the nozzle formation surface is longer than a distance between the first positioning portion and the nozzle formation surface in the medium transport direction.

10. The liquid ejecting apparatus according to claim 5, wherein, the head holding member is provided with a recessed portion or a through-hole, the second positioning portion includes a protrusion inserted into the recessed portion or the through-hole, and a distance between the recessed portion or the through-hole and the nozzle formation surface is longer than a distance between the first positioning portion and the nozzle formation surface in the medium transport direction.

11. A liquid ejecting apparatus comprising:

a first roller;

a second roller, the first roller and the second roller configured to transport a medium in a medium transport direction, the second roller being disposed downstream of the first roller in the medium transport direction, a distance in the medium transport direction between the first roller and the second roller being a first distance that is longer than a second distance;

a liquid ejecting head disposed in the medium transport direction between the first roller and the second roller, the liquid ejecting head configured to eject a liquid onto a medium transported by the first roller and the second roller; and a head holding member mounting the liquid ejecting head to the liquid ejecting apparatus, the liquid ejecting head comprising:

a first positioning portion mounting the liquid ejecting head to the liquid ejecting apparatus in which the distance in the medium transport direction between the first roller and the second roller is the first distance in the medium transport direction, the first positioning portion also positioning the liquid ejecting head with respect to the head holding member; and a second positioning portion configured to be used if mounting the liquid ejecting head to another liquid ejecting apparatus between a first roller and a second roller used to transport a medium in a medium transport of the other liquid ejecting apparatus, and in which a distance in the medium transport direction of the other liquid ejecting apparatus between the first roller and the second roller of the other liquid ejecting apparatus is the second distance.

12. The liquid ejecting apparatus according to claim 11, wherein the first positioning portion and the second positioning portion are disposed on an upstream than the nozzle formation surface in the medium transport direction, and a distance between the first roller and the nozzle formation surface is longer than a distance between the first positioning portion and the nozzle formation surface in the medium transport direction.

13. The liquid ejecting apparatus according to claim 11, wherein the first positioning portion and the second positioning portion are disposed on a downstream than the nozzle formation surface in the medium transport direction, and a distance between the second roller and the nozzle formation surface is longer than a distance between the first positioning portion and the nozzle formation surface in the medium transport direction.

14. The liquid ejecting apparatus according to claim 11, wherein the head holding member is provided with a protrusion, the first positioning portion includes a recessed portion or a through-hole into which the protrusion is inserted, and a distance between the protrusion and the nozzle formation surface is shorter than a distance between the second positioning portion and the nozzle formation surface in the medium transport direction.

15. The liquid ejecting apparatus according to claim 11, wherein the head holding member is provided with a recessed portion or a through-hole, the first positioning portion includes a protrusion inserted into the recessed portion or the through-hole, and a distance between the protrusion and the nozzle formation surface is shorter than a distance between the second positioning portion and the nozzle formation surface in the medium transport direction.

16. The liquid ejecting head according to claim 2, wherein a distance between the first positioning portion and the nozzle formation surface is shorter than a distance between the second positioning portion and the nozzle formation surface in a direction orthogonal to the nozzle formation surface.

17. The liquid ejecting head according to claim 2, further comprising:

a first member provided with the first positioning portion; and a second member provided with the second positioning portion, wherein the nozzle formation surface is disposed closer to the first member than the second member in a direction orthogonal to the nozzle formation surface.

18. The liquid ejecting head according to claim 3, further comprising:

a first member provided with the first positioning portion; and a second member provided with the second positioning portion, wherein the nozzle formation surface is disposed closer to the first member than the second member in the direction orthogonal to the nozzle formation surface.

19. The liquid ejecting head according to claim 16, further comprising:

a first member provided with the first positioning portion; and a second member provided with the second positioning portion, wherein the nozzle formation surface is disposed closer to the first member than to the second member in the direction orthogonal to the nozzle formation surface.

* * * * *